US006842935B2

(12) United States Patent
Peterson

(10) Patent No.: US 6,842,935 B2
(45) Date of Patent: Jan. 18, 2005

(54) TOILET BOWL BRUSH CLEANING SYSTEM

(76) Inventor: Tammy Leilani Peterson, R.R. 1 Box 41 A, Jacksonville, MO (US) 65260

( * ) Notice: Subject to any disclaimer, the term of this patent is extended or adjusted under 35 U.S.C. 154(b) by 115 days.

(21) Appl. No.: 10/032,433

(22) Filed: Dec. 31, 2001

(65) Prior Publication Data

US 2003/0098044 A1 May 29, 2003

Related U.S. Application Data

(60) Provisional application No. 60/260,152, filed on Jan. 8, 2001.

(51) Int. Cl.[7] ..... A46B 17/00; A47G 29/08; A47L 25/00

(52) U.S. Cl. ..... 15/104.92; 15/257.01; 15/260; 134/135

(58) Field of Search ..... 15/104.92, 257.01, 15/1, 260; 422/292, 300; 312/206–207; 134/135, 186, 201; 206/209–209.1, 349, 361

(56) References Cited

U.S. PATENT DOCUMENTS

| | | | | | |
|---|---|---|---|---|---|
| 1,283,403 | A | * | 10/1918 | Eustis | 312/207 |
| 1,285,948 | A | * | 11/1918 | Cook | 15/1 |
| 2,965,111 | A | * | 12/1960 | Feigelman | 134/135 |
| 4,734,952 | A | * | 4/1988 | Parchment et al. | 15/104.92 |
| 5,259,406 | A | * | 11/1993 | Hofmann | 134/50 |
| 5,945,076 | A | * | 8/1999 | Leonard et al. | 422/300 |
| 6,035,456 | A | * | 3/2000 | Taylor | 4/255.11 |
| 6,050,401 | A | * | 4/2000 | Michaelson | 206/225 |

* cited by examiner

*Primary Examiner*—Robert J. Warden, Sr.
*Assistant Examiner*—Laura C Cole

(57) ABSTRACT

A toilet bowl brush cleaning system enabling a person to have a easy and sanitary way of cleaning and storing the toilet bowl brush between each use. It's a cleaning system for the toilet bowl brush. The toilet bowl brush cleaning system may be provided with a selected color so as to match the users preferred color. It may also be provided in various shapes and sizes or materials to also suit the users preference. The toilet bowl brush cleaning system is designed to allow the user to put the toilet brush in the cleaning system, into a cleaning agent located in the second level, to be cleaned and disinfected and then pulled back up through a ringer that will ring out the remaining liquid. Then the toilet brush will be stored in the first level thus allowing any cleaner that may remain on the brush to drain off into the second level. The toilet bowl brush is now ready for its next use. This cleaning system will allow the toilet bowl brush to be cleaned and disinfected between uses, so the user no longer has to clean his or her toilet brush in the sink or bathtub, or have the toilet waste that drains off of the toilet bowl brush, gathering at the bottom of the toilet brush holder after each use. The user of the cleaning system will fill the second level of the cleaning system with a cleaner of their choice for the cleaning of the toilet bowl brush. This system will have a disposable third level or compartment for the used cleaner at the bottom of the cleaning system. The used cleaner can be passed from the second level to the third level by pulling up on the stopper which will allow the used cleaner to drain from the second level to the third level or compartment. This third level can be removed and replaced with a new compartment or cleaned and replaced The third level compartment will be big enough thus allowing the user to empty the used cleaner into this compartment or level more than once before having to be replaced with a new, level or compartment.

20 Claims, 1 Drawing Sheet

TOILET BOWL BRUSH CLEANING SYSTEM

This non-provisional patent application claims the benefit of the prior filing date of the provisional application filed on, Jan. 8, 2001. U.S. application Ser. No. 60/260,152. Name and address of applicant, Tammy Leilani Peterson, R1 Box 41A, Jacksonville, Mo. 65260. Title of invention, Toilet Bowl Brush Cleaning System BE IT KNOWN THAT I, TAMMY LEILANI PETERSON, a citizen of the United States and resident of the city of Jacksonville, States of Missouri, have invented a certain new and useful Toilet Bowl Brush Cleaning System of which the following is a specification containing the best mode of the invention known to me at the time of filing an application for letters patent therefore.

BACKGROUND OF THE INVENTION

1. Field of the Invention

This invention relates in general to certain new and useful improvements in the cleaning and storing of the toilet bowl brush, and more particularly, to a toilet bowl brush, cleaning system and which effectively enables the toilet bowl brush to be cleaned, disinfected and stored all in one.

2. Brief Description of the Related Art

There are numerous styles of toilet bowl brush holders. One of which is filly open at the side and allows any waste or fluids on the toilet bowl brush after cleaning the toilet bowl to freely run out onto the floor spreading germs. Another holder has an indent or groove at the bottom of the holder allowing the waste that drains off the toilet bowl brush to gather at the bottom of the holder after every use allowing the waste to produce and spread germs in the bathroom and on the toilet. These containers or holders are designed only to hold or store the toilet bowl brush.

The problem with these toilet bowl brush holders is that they allow more germs to spread throughout the bathroom. These toilet brush holders tend to get knocked over easily and spread toilet waste throughout the bathroom. They also drip the toilet waste that the toilet bowl brush has been sitting in, on the floor or toilet seat when the user chooses to use the brush again causing people to step on it and spread germs throughout the house. Washing the toilet bowl brush in the sink or bathtub allows germs to splatter on the surface of the sink, walls, and person's clothes or floor. Furthermore not cleaning the toilet bowl brush or its holder allows the waste to remain on the toilet bowl brush and to accumulate into the brush holder and potentially spread gems causing the person using the toilet bowl brush to clean out the holder and the toilet brush by hand, which can lead to splattering of the waste again on the sink, walls, person's clothes or floor that can allow more germs to spread. Furthermore none of these toilet bowl brush holders are designed to clean the toilet bowls brush.

There has been a need for a toilet bowl brush cleaning system to enable a user too easily and safely clean, disinfect and store the toilet howl brush that would eliminate the need for hand washing the toilet bowl brush in a sink or bathtub. There has also been the need for a toilet bowl brush cleaning system that does not allow the toilet bowl brush to sit in toilet waste that comes from the toilet bowl. There has also been a need for a toilet bowl brush cleaning system that will be of help in preventing the spreading of more germs.

OBJECTS OF THE INVENTION

It is, therefore, one of the primary objects of the present invention to provide a toilet bowl brush cleaning system which enables the user to have a healthier way of cleaning, disinfecting and storing the toilet bowl brush.

It is another object of the present invention to provide a toilet bowl brush cleaning system of the type stated which enables the user to clean and store the toilet brush in the same unit.

It is a further object of the present invention to provide a toilet bowl brush cleaning system of the type stated that gives the user a way of cleaning the toilet bowl brush without causing more germs to be spread in the process of trying to clean it.

It is an additional object of the present invention to provide a toilet bowl brush cleaning system of the type stated giving the user a decorative cleaning and storing system for the toilet bowl brush.

It is also an object of the present invention to provide a toilet bowl brush cleaning system of the type stated which is easy to use.

It is another object of the present invention to provide a toilet bowl brush cleaning system of the type stated which could be produced at a relatively low cost and which is therefore highly affordable.

With the above and other objects in view, my invention resides in the novel features of form, construction, arrangement and combination of parts and components presently described and pointed out in the claims.

SUMMARY OF THE INVENTION

A toilet howl brush cleaning system which can be used for the cleaning, disinfecting and storing of the toilet bowl brush, which were not heretofore available. The toilet bowl brush cleaning system of the invention is designed to clean, disinfect, store, and be easily accessible, easy to use and enabling the user to have a healthier way of cleaning the toilet bowl brush.

The toilet howl brush cleaning system of the present invention generally comprises an elongate member, which is a cylindrically shaped chamber and has separate interior compartments preferably, although not necessarily of a cylindrically shaped construction. The toilet bowl brush cleaning system is typically formed of a material or materials capable of holding fluids and preventing leaks. Various rubber and plastic materials, as hereinafter described, are available for the construction.

In one of the more preferred forms of construction, the toilet bowl brush cleaning system is formed with a hard plastic, such as polypropylene which consists of three levels or compartments. The first level or compartment has an open end at the top, this opening will be the entrance for the toilet bowl brush and a way of adding the cleaner being used to be put in the cleaning system. The bottom of the first level in the preferred invention will have seven circular shaped openings in it, so as to allow the toilet bowl brush to be drained and stored on. This first level will have an additional opening allowing the stopper to extend through to the second level or compartment. In addition to the previously stated openings the bottom of the first level in the preferred invention will also have an opening in the center that will he used to ring out the toilet bowl brush after the cleaning of the toilet brush. The toilet bowl brush will be pushed through the ringer into the second level, this level holds the toilet bowl brush cleaning agent. The toilet bowl brush will then be emerged in the toilet bowl brush cleaner allowing enough time to be cleaned and disinfected then pulled back up through the ringer and stored in the first level by resting it on the strainer. The amount of time needed to clean the toilet bowl brush depends on the cleaning agent the user of the system chooses to use in his or her system. In the second level in the preferred form of construction, the bottom of this level will be slightly slanted and have a rectangular shaped opening for the draining of the used cleaner. This opening will be plugged with a stopper. The stopper in the preferred invention will have an elongate body and cylindrically shaped made of a hard plastic preferably polypropylene. The stopper will also have a triangular shaped rubber end or plug. This stopper extends up through and past the first level about an inch above the toilet bowl brush cleaning system so the user of the cleaning system can easily pull it up to release the used cleaner or push it down to seal the cleaner in. This second level has external threads allowing it to be fastened and unfastened to the third level or compartment. The third level or compartment of the cleaning system is used for the purpose of storing the used cleaner. This third level or compartment will allow the used cleaner to be released into its compartment more than once before needing to be disposed of or replaced. This third level or compartment has internal threads allowing it to be detached from the remainder of the cleaning system by unfastening it for easy disposal of the used cleaner. The user of the cleaning system will have the options to re-use the third compartment or dispose of this compartment and replace it with a new compartment, which will also be made available.

The toilet bowl brush cleaning system typically has a height of twenty-two inches. In actuality, there is no critical limit to the height, although for purposes of fitting the toilet bowl brush into the cleaning system, it has been found that the toilet bowl brush cleaning system should be at least twenty-two inches in height. The toilet bowl brush cleaning system typically has an inside diameter of five inches and an outside diameter of approximately five and one-eighth of an inch. In actuality there is no critical limit to the diameter or cross-sectional size, although for purposes of fitting the toilet bowl brush into the cleaning system, it has been found that the toilet bowl brush cleaning system should have an inside diameter of five inches. However, it can be seen that the toilet bowl brush cleaning system can be provided in a variety of shapes and sizes allowing the user to select a particular shape or size. The toilet bowl brush cleaning system of the present invention is preferably cylindrically shaped, as aforesaid. However, it may be provided in a variety of cross-sectional shapes, sizes, materials, patterns and colors, including elliptical shapes, rectangular shapes and the like.

The foregoing objects and the advantages of this invention have been met and fulfilled by this system and method which has been briefly described in the general description. However, the invention will now be described in more detail in the following detailed description and in the accompanying drawings. Nevertheless, it is to be understood that these drawings and the following detailed description arc only set forth for purposes of illustrating the general principles of the invention. Therefore, it should be understood that the accompanying drawings and the following detailed descriptions are not to be taken in a limiting sense.

BRIEF DESCRIPTION OF THE DRAWINGS

Figure 1:
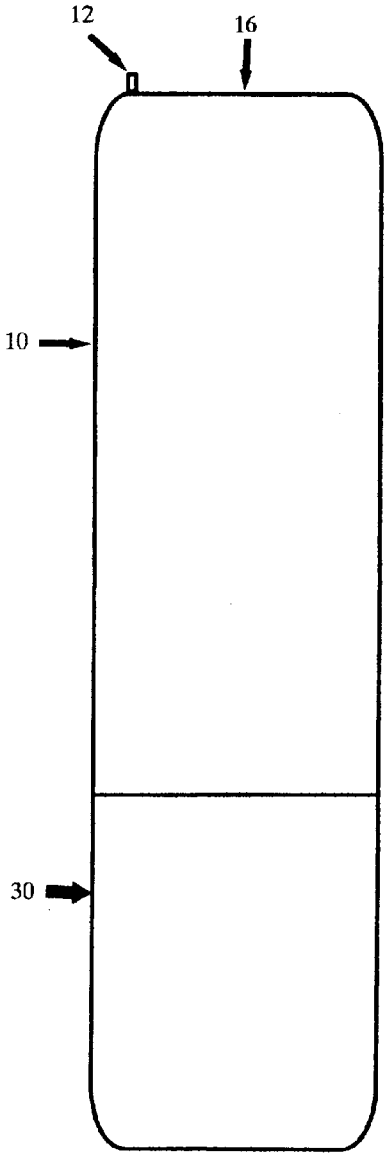
Figure 2:
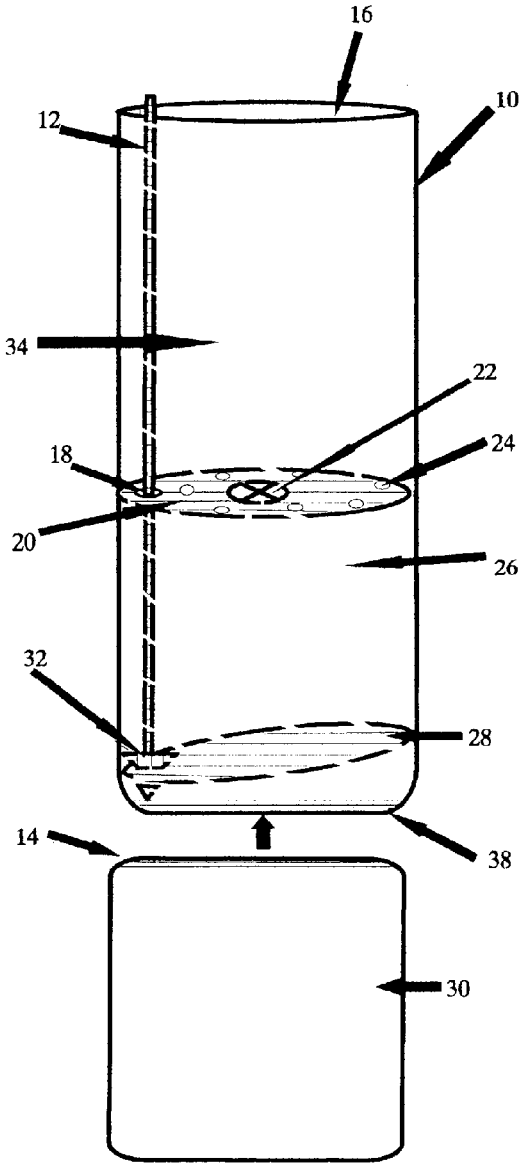

Having thus described the invention in general terms, reference will now be made to the accompanying drawings in which:

FIG. 1 is a prospective view of a toilet bowl brush cleaning system constructed in accordance with and embodying the present invention;

FIG. 2 is a vertical, sectional view showing the interior construction of a preferred form of toilet bowl brush cleaning system of FIG. 1.

DETAILED DESCRIPTION OF A PREFERRED EMBODIMENT

Referring now in more detail and by reference characters to the drawings which illustrate a practical embodiment of the present invention, FIG. 1 designates an embodiment of a toilet bowl brush cleaning system, having an elongate chamber 10, and a stopper 12 in the form of plastic and rubber and both of which arc hereinafter described in more detail. The body of 10 of the toilet bowl brush cleaning system of the present invention is a cylindrically shaped chamber as shown and as indicated previously, can have a height, which is sized to accommodate a toilet bowl brush.

The toilet bowl brush cleaning system in the embodiment as shown, is cylindrically shaped in cross-section and, in this particular embodiment, has a height of twenty-two inches an inside diameter of five inches and an outside diameter of about five and one-eight of an inch. However, again, the height and diameter of this cleaning system can vary, also depending upon the overall size and shape of the toilet bowl brush, which is to be cleaned with the cleaning system.

As indicated previously, both the height and the cross-sectional shape and the diameter or cross-sectional size of the toilet bowl brush cleaning system can vary. In connection with the following embodiments, it should be understood like reference numerals will be used to represent like components.

FIG. 1 illustrates an exterior view of the embodiment 10 of the present invention. In this illustration, the third compartment or the used cleaner compartment 30 having an outside diameter of approximately five and one-eighth of an inch, an inside diameter of five inches and a height of approximately five inches can be detached by unfastening it from the remainder of the embodiment 10. Also, in the embodiment of figure land FIG. 2 as hereinafter described, a plastic stopper is employed. In the FIG. 1, the stopper 12 extends through the opening 16 approximately one inch above the top of the embodiment 10 allowing the user easier access to the stopper. The stopper 12 having a height of approximately eighteen inches measuring from end to end and a diameter of one-forth of an inch. The triangularly shaped end 32 of the stopper 12 measures approximately thirteen-sixteenths of an inch in height, a top length of one and five-sixteenths of an inch, a bottom length of one-forth of an inch and a width of five-eighths of an inch. The stopper 12 is used for the purpose of releasing or holding the cleaning agent in the second level. The stopper 12 is inserted within the body or chamber 10 of FIG. 2 much in the same manner.

FIG. 2 illustrates a sectional view of the embodiment 10 of the preferred invention. The embodiment 10 of the present invention is a chamber, this chamber has a thickness of approximately one-sixteenth of an inch. In the embodiment 10 of FIG. 2 the first level 34 having a height of approximately thirteen inches and a in side diameter of five inches and an outside diameter of five and one-eighth of an inch as do FIG. 1. The bottom 20 of the first level 34 has seven circularly shaped openings 24 for draining the cleaned toilet brush. These openings are positioned about one forth of an inch from the outside edge of the bottom of this level and approximately one and one-half inches apart and having a cross-sectional diameter of approximately one-forth of an inch. However, it should be understood that the size, shape, position and number of these openings can vary. In addition to these openings 24, the bottom 20 of 34 has a rectangular shaped opening 18, measuring approximately two inches in length and three-fourths of an inch in width, thus allowing the stopper to pass through its bottom. This opening 18 is positioned about one-forth on an inch from the outer edge of the bottom 20. Also located on this bottom 20 of the top compartment 34, positioned horizontally and in the center of the bottom 20 is the said wringer 22. The wringer 22 measures approximately two and one-half inches in diameter or cross-sectional size. The said wringer 22 consists of four flat triangular shaped flaps with the tips pointing in the center. These said flaps are spaced approximately one eighth of an inch apart from each other. This ringer in the preferred invention is formed of a flexible plastic such as so to allow the toilet bowl brush to easily be pushed or pulled through the flaps. The second level 26 of FIG. 2 having an exterior height of approximately four and one-half of an inch. However the bottom exterior of this level extends past the interior bottom 28 of this second level 26 The interior bottom 28 is positioned at an angle giving it an inside measurement of approximately three and three-sixteenths of an inch in height at one end to four and one-forth of an inch in height at the opposite end, measuring from the top of the second level 26 to he interior bottom 28 of this second level. This second level 26 has external threads 38 measuring approximately one-forth of an inch in height and also having an inside diameter of approximately five inches. The interior bottom 28 of the second level 26 has a rectangular shaped opening 36 for the rubber end 32 of the stopper to be inserted in this opening, thus allowing the plugging and unplugging of this second level made to hold or release the cleaning agent. This opening 36 having a measurement of approximately seven-eighths of an inch in length and approximately five-eighths of an inch in width. The above mentioned opening allows the plug 32 at the end of the stopper 12 to fit in this opening 36 without allowing the cleaning agent to flow through until it is necessary to release the cleaning agent into the third level or compartment 30.

The third level or compartment 30 of the cleaning system has a measurement of approximately five inches in height and inside diameter of five inches and an outside diameter of approximately five and one-eight of an inch This third level or compartment 30 is for the purpose of storing the used cleaning agent. This third compartment 30 is threaded 14 at the top thus making it removable. These internal threads 14 extend about one-forth of an inch down from the top of this third level or compartment 30. This removable and replaceable compartment 30 will also be made available.

Having thus described my invention, what I desire to claim and secure by letters paten is:

1. A toilet bowl brush cleaning system for cleaning, disinfecting and storing the toilet bowl brush, said cleaning system comprising:

a) an elongate body having a cross-sectional shape and size which is capable of containing a liquid;

b) said body being formed of a hard and durable material;

c) said body having three separate compartments arranged vertically, the first compartment having a first level located at a top-most position, a second compartment having a second level in a vertically central position, and a third compartment is in a lower most position;

d) a plugging member extending inside the body and the first and second compartments for scaling of liquid in the body; and e) a wringer inside the body of the cleaning system for wringing a toilet brush.

2. The cleaning system of claim 1 further characterized in that said plugging member is a stopper.

3. The cleaning system of claim 2 further characterized in that said stopper extends inside said body from the top of the cleaning system and partially through the bottom of its second level.

4. The cleaning system of claim 3 further characterized in that said stopper has triangularly shaped rubber end.

5. The cleaning system of claim 4 further characterized in that said rubber end is made of a durable and flexible material.

6. The cleaning system of claim 3 further characterized in that said stopper is formed of a hard and durable material.

7. The cleaning system of claim 3 further characterized in that said stopper has a cylindrically shaped cross-section.

8. The cleaning system of claim 1 further characterized in that said body has a cylindrically shaped cross-section.

9. The cleaning system of claim 1 farther characterized in that said body can be Formed into any conceivable shape.

10. The cleaning system of claim 1 further characterized in that said first level has ten separate openings.

11. The cleaning system of claim 10 further characterized in that one of the said openings are for the toilet bowl brush, the cleaning agent and stopper.

12. The cleaning system of claim 10 farther characterized in that seven of the said openings in the first level are for drainage.

13. The cleaning system of claim 10 further characterized in that one of the said openings are the said wringer.

14. The cleaning system of claim 13 further characterized in that said wringer has a center of four flat flaps somewhat conical shaped, positioned horizontally and separated one from the other allowing an opening for the toilet bowl brush.

15. The cleaning system of claim 14 further characterized in that said flat flaps are of a flexible material.

16. The cleaning system of claim 1 further characterized in that said second level has an opening at the bottom for the stopper.

17. The cleaning system of claim 16 further characterized in that said opening is also for drainage.

18. The cleaning system of claim 1 further characterized in that the bottom of said second level is positioned at an angle.

19. The cleaning system of claim 1 further characterized in that said third level is a storage compartment.

20. The cleaning system of claim 19 further characterized in that said third level is removable and thus replaceable.

* * * * *